United States Patent [19]

Nagy

[11] 4,421,308

[45] Dec. 20, 1983

[54] BICYCLE EXERCISE STAND

[76] Inventor: Gerald A. Nagy, 6731 Rockdale, Dearborn Heights, Mich. 48127

[21] Appl. No.: 330,711

[22] Filed: Dec. 14, 1981

[51] Int. Cl.[3] ..... A63B 69/16

[52] U.S. Cl. ..... 272/73; 211/22

[58] Field of Search ..... 272/73, 132; 211/22

[56] References Cited

U.S. PATENT DOCUMENTS

| | | | |
|---|---|---|---|
| 553,373 | 1/1896 | Webber | 272/73 |
| 2,534,967 | 12/1950 | Hapman | 272/73 |
| 3,107,915 | 10/1963 | Looney | 272/73 |
| 3,352,426 | 11/1967 | Carlson | 272/73 |
| 3,368,809 | 2/1968 | Duane | 272/73 |
| 3,866,908 | 2/1975 | Hangler | 272/73 |

*Primary Examiner*—Richard J. Johnson

*Attorney, Agent, or Firm*—Charles W. Chandler

[57] ABSTRACT

A bicycle stand for supporting the rear wheel of a bicycle in such a manner that the user can perform stationary bicycle exercises. The stand comprises a pair of upright, tubular members, and a pair of right angle pins for supporting the bicycle wheel axle such that its vertical and horizontal position on the stand can be adjusted to accommodate wheels of different diameters, as well as widths. The pins are carried by the bicycle rear axle during normal street use.

5 Claims, 3 Drawing Figures

BICYCLE EXERCISE STAND

BACKGROUND OF THE INVENTION

This invention is related to bicycle exercising stands for supporting a bicycle for stationary exercises, and more particularly to such a stand that accommodates bicycles of different diameters, as well as conventional speed bicycles having a multi-sprocket arrangement on one side of the rear wheel.

Bicycle stands for supporting a bicycle for indoor exercises are widely known in the art. For example, such stands are illustrated in U.S. Pat. No. 3,352,426 which issued to Carlson and U.S. Pat. No. 3,866,908 which issued to Hangler. Usually such stands comprise a base with a pair of upright supports. Means are provided on the upper end of the supports for engaging the bicycle's rear axle. A roller, about the size of a roller skating wheel, is mounted on the stand to engage the bicycle wheel to resist wheel rotation by the user cranking the pedals.

One problem with commercially available stands is that they will not accommodate the "speed" bikes having a multi-sprocket arrangement mounted on one side of the rear wheel to change the turning ratio between the pedal and the rear wheel. In addition, prior art bicycle stands require a large number of components that cannot be readily adjusted to accommodate wheels of different diameters.

SUMMARY OF THE INVENTION

The broad purpose of the present invention is to provide an improved bicycle exercising stand comprising a base having a pair of upright, tubular members for receiving a pair of right angle pins. Each pin has one end that is receivable in the tubular member so as to be locked in an adjusted vertical position to accommodate the diameter of the bicycle's rear wheel. The opposite end of each pin is threaded to accommodate a pair of brackets mounted on the rear axle of the bicycle. The brackets are horizontally adjustable to accommodate the distance between the opposite ends of the bicycle's rear axle. In addition, one bracket can be substantially offset from the center line of the bicycle to accommodate the multi-sprocket mechanism carried on one side of speed bicycles. The preferred stand also has a roller for engaging the bicycle wheel to provide resistance for the user pedalling the bicycle.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
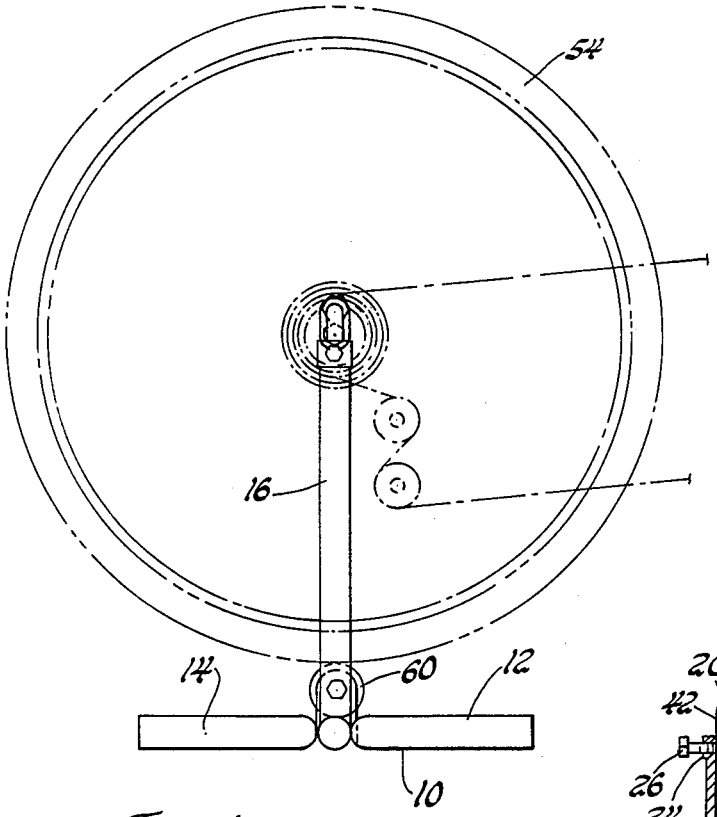
FIG. 1 is an elevational view of the rear wheel of a speed bike mounted on a bicycle stand illustrating the preferred embodiment of the invention.
Figure 2:
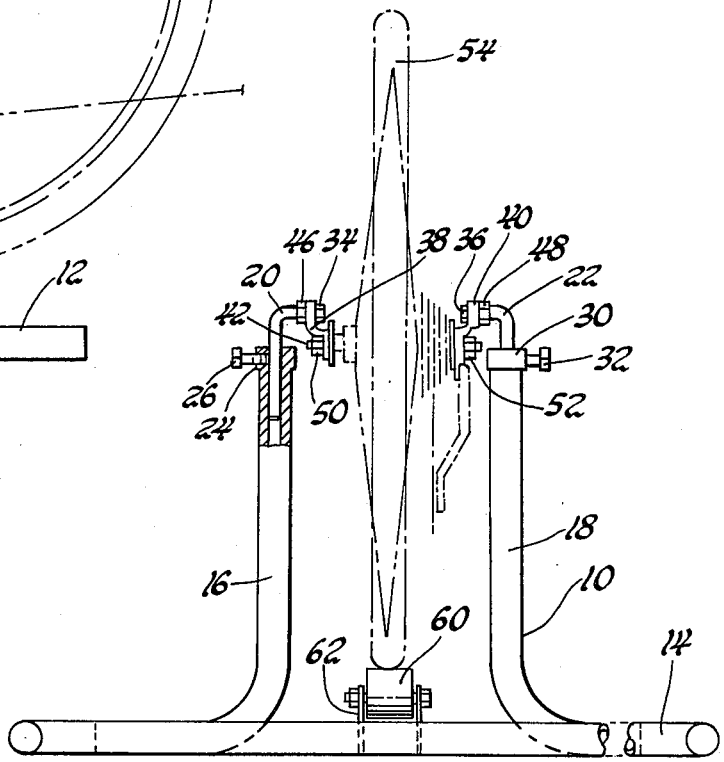
FIG. 2 is a view as seen from the left side of FIG. 1.
Figure 3:
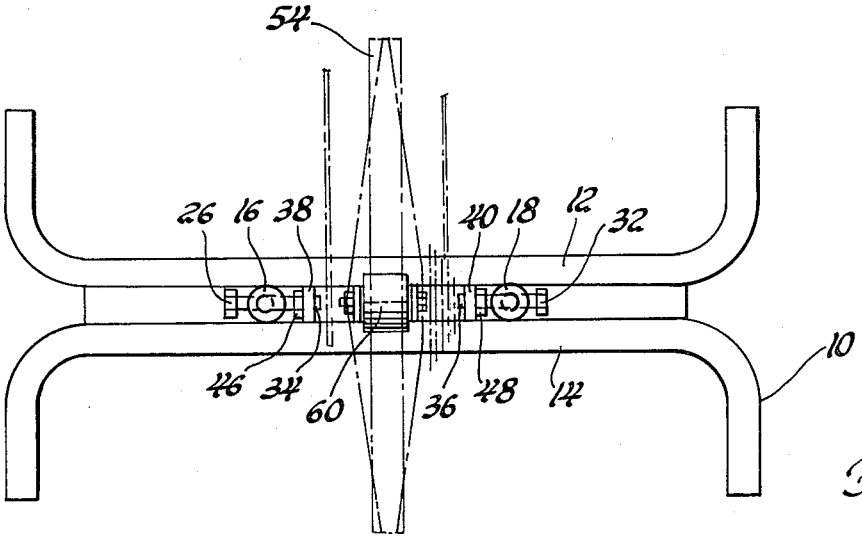
FIG. 3 is a reduced plan view of FIG. 2.

Referring to the drawing, a preferred bicycle exercise stand is illustrated in FIGS. 1 to 3 at 10, and is formed of a pair of tubular, generally U-shaped base members 12 and 14 mounted back-to-back.

A pair of tubular L-shaped, upright supports 16 and 18, each has its lower end attached between the two base members, as illustrated in FIG. 2. Upright supports 16 and 18 have upper open ends for receiving pins 20 and 22. A collar 24 is attached to the upper end of support 16 for receiving one end of pin 20. A threaded member 26 is mounted on the collar for engaging pin 20 for locking it in an adjusted vertical position. Similarly, a collar 30 is attached to the upper end of support 18 and carries a threaded member 32 for locking pin 22 in an adjusted vertical position.

Pins 20 and 22 each has a pair of ends disposed at right angles to one another, as illustrated in FIG. 2. The larger unthreaded ends of the pins are received in the upper ends of supports 16 and 18, while the opposite pin ends are threaded as at 34 and 36.

A pair of brackets 38 and 40 provide means for connecting pins 34 and 36 to the opposite ends of bicycle wheel axle 42. Brackets 38 and 40 each has an opening in one end for receiving its corresponding pin and an opening at the opposite end for mounting on the axle. A nut 46 is threadably mounted on pin 20 to cooperate with a similar nut 48 carried on the threaded end of pin 22 to clamp brackets 38 and 40 between them.

Similarly, nuts 50 and 52 are mounted on the opposite ends of the axle for clamping supports 38 and 40 onto the axle. It is to be noted that the horizontal position of a bicycle wheel 54 (illustrated in phantom) carried on the axle can be adjusted by merely adjusting the position of nuts 46 and 48. Similarly, the height of the bicycle wheel axle can be adjusted by loosening threaded members 26 and 32, raising or lowering the bicycle wheels as desired and then tightening the threaded members 26 and 32 on their respective collars.

A roller 60 is mounted on the base between the supports 16 and 18 by means 62 for engaging bicycle wheel 54. The user adjusts the resistance of the roller to the bicycle wheel rotation by adjusting threaded members 26 and 32. Such an adjustment is accomplished by loosening bolts 26 and 32, applying a downward effort on the bicycle toward the roller and tightening fasteners 26 and 32.

The bicycle can be readily removed from the stand by loosening threaded members 26 and 32 to raise the bicycle from the stand with the pins.

Preferably the brackets and the pins remain mounted on the rear wheel axle after the bicycle has been removed from the exercise stand for use for street riding. This provides a special advantage over most commercially available exercise stands because the bicycle can be either removed from or mounted on the stand in a matter of seconds by simply loosening and tightening fasteners 26 and 32, as the case may be, after the pins have been inserted in the upright support 16 and 18. Most commercially available stands require several components to be loosened and adjusted in order to either mount the bike on or to remove it from the stand.

Having described my invention, I claim:

1. An exercise stand for a bicycle having a driven wheel carried on a rear axle, comprising:

base means including a pair of parallel tubular members spaced a sufficient distance for receiving the driven wheel of the bicycle between them, said tubular members each having respective pin-receiving opening means;

a pair of elongated pin means, each of said pin means having a first end and a second end disposed at right angles, the first end of each pin being threaded;

bracket means for attaching said pin means to the ends of the rear axle of the bicycle, such that the second ends thereof are disposed in a spaced parallel relationship on opposite ends of the wheel axle, a distance accommodating the distance between the pin-receiving opening means of the tubular members, the second ends thereof being receivable in said pin-receiving openings;

means engageable with the first ends of the pin means for adjusting the position of the wheel between the tubular members;

collar means receiving the pin means and mounted on the ends of the tubular members;

fastener means on each of the collar means for connecting same to the pin means at an adjusted vertical position; and a roller member mounted on the base means for rotation a distance generally corresponding to the radius of the bicycle wheel to resist rotation thereof.

2. A bicycle exercise stand as defined in claim 1, in which the bracket means are so connected to the rear axle of the bicycle that the bicycle wheel and the bracket means are removable as a unit from the base means.

3. A bicycle exercise stand as defined in claim 1, in which the bracket means and the pin means are so connected to opposite ends of the wheel axle as to be removable as a unit from the tubular members.

4. A bicycle exercise stand as defined in claim 1, in which the means engageable with the ends of the pin means comprise fastener means mounted on the pin for adjusting the horizontal position of the axle between the upright tubular members.

5. A bicycle exercise stand as defined in claim 1, in which the roller is disposed in a position between the two tubular members, and wherein one of the brackets is disposed closer to its corresponding tubular member than the other bracket to accommodate a wheel having a multi-sprocket device.

* * * * *